United States Patent [19]

Fleiter et al.

[11] Patent Number: 4,970,372

[45] Date of Patent: Nov. 13, 1990

[54] FURNACE FOR THE THERMAL TREATMENT OF IRON AND STEEL COMPONENTS

[75] Inventors: Albert Fleiter, Kleve-Donsbrüggen; Wolfgang Peter, Emmerich, both of Fed. Rep. of Germany

[73] Assignee: Ipsen Industries International GmbH, Kleve, Fed. Rep. of Germany

[21] Appl. No.: 359,407

[22] Filed: May 31, 1989

[30] Foreign Application Priority Data

May 31, 1988 [DE] Fed. Rep. of Germany ..... 3818471

[51] Int. Cl.[5] ..... H05B 3/62; F27D 7/04

[52] U.S. Cl. ..... 219/400; 219/411; 392/478

[58] Field of Search ..... 219/400, 300, 375, 376, 219/405, 411, 354

[56] References Cited

U.S. PATENT DOCUMENTS

| | | | |
|---|---|---|---|
| 845,051 | 2/1907 | Von Brockdorff | 219/300 |
| 1,809,227 | 6/1931 | Baily | 219/300 |
| 4,233,494 | 11/1980 | Pawlik | 219/300 |

FOREIGN PATENT DOCUMENTS

| | | | |
|---|---|---|---|
| 275586 | 10/1913 | Fed. Rep. of Germany | 219/300 |

*Primary Examiner*—Teresa J. Walberg

*Attorney, Agent, or Firm*—Robert W. Becker & Associates

[57] ABSTRACT

A furnace for the thermal treatment of charges of iron and steel components. A cylindrical, vertical heating chamber is disposed within a housing. A plurality of vertical heating elements are disposed in the heating chamber. To accelerate the heating-up of a charge that is disposed within the heating chamber, especially in the lower temperature range, the heating elements have a tubular construction and are provided at their bottom end with an outlet opening. Gas conveyed by a fan flows through the heating elements, at which time it is convectively heated, and thereafter passes into the interior of the heating chamber. In the higher temperature range, the heating elements transfer their heat to the charge as radiant heat, with the furnace then operating in a vacuum.

14 Claims, 1 Drawing Sheet

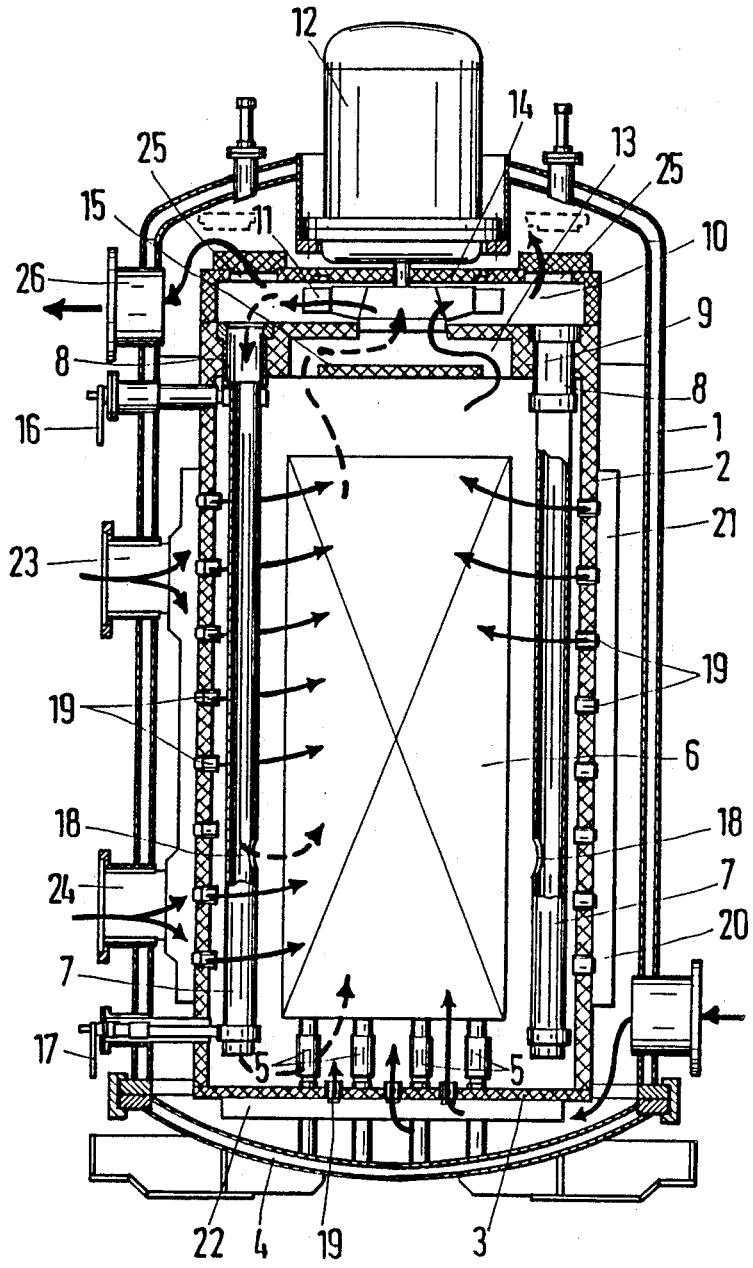
12
14
13
25
25
15
11
10
26
9
8
8
16
1
2
21
23
19
19
6
18
18
24
7
20
7
17
5
5
22
4
19
3

FURNACE FOR THE THERMAL TREATMENT OF IRON AND STEEL COMPONENTS

BACKGROUND OF THE INVENTION

1. Field of the Invention

The present invention relates to a furnace for the thermal treatment of charges of iron and steel components. The furnace includes a housing, a heating chamber disposed in the housing, and electrically energized heating elements that are disposed in the heating chamber for heating up the charge.

2. Description of the Prior Art

Furnaces for the thermal treatment of iron and steel components are known where heating-up of the charge is effected via heating elements that are disposed within the heating chamber and that are comprised either of graphite or, where greater thermal stress is encountered, of molybdenum. These heating elements are generally secured to the inner wall of the heating chamber, with the electrical connections for the heating elements extending through the wall of the heating chamber.

Furnaces embodied in this manner are predominantly operated as vacuum furnaces. In this connection, the furnace is evacuated for the duration of the process of heating up the charge. Thus, the charge is heated up nearly exclusively by heat radiated directly from the heating elements.

In order to provide for a controlled cooling of the charge, the heretofore known furnace is provided with a system for the supply of cooling gas; gas flows to the charge in a defined manner via a plurality of cooling gas openings in the heating chamber. A desired cooling of a specific portion or portions of the charge can in particular be undertaken by supplying only some of the cooling gas openings. Loading of the heretofore known furnace is effected in a vertical direction by delivering the base, which is loaded with the charge, to the furnace from below, as a result of which the charge enters the heating chamber.

Unfortunately, this heretofore known construction has the drawback that the rate of heating in the lower temperature range is very slow because the heat transfer via radiation tends to still be slow. Although convection can bring about considerable improvements in this temperature range, the air that circulates within the heating chamber requires a long period of time before it is heated up by the heating elements and can transfer this heat convectively to the charge. In addition, due to the small surface area of the heating elements, which are made of solid material, the radiation surface of the heating elements remains small. However, the magnitude of the radiation surface is proportional to the magnitude of the quantity of heat that can be radiated. Furthermore, due to their great thickness, the heating elements still radiate heat after energy is no longer supplied to the heating elements, thus delaying the beginning of the subsequent cooling phase.

It is therefore an object of the present invention to provide a furnace for the thermal treatment of iron and steel components that permits a rapid and uniform heating-up in every temperature range, that operates efficiently, and that permits a rapid reduction of temperature in the cooling phase.

BRIEF DESCRIPTION OF THE DRAWING

This object, and other objects and advantages of the present invention, will appear more clearly from the following specification in conjunction with the accompanying schematic drawing, which is a cross-sectional view of one preferred exemplary embodiment of the inventive furnace for the thermal treatment of iron and steel components.

SUMMARY OF THE INVENTION

The furnace of the present invention is characterized primarily in that the heating elements have a tubular construction and are adapted to receive a flow of gas therethrough for heating up the same.

A furnace embodied in this manner has the advantage that a rapid heating up of the charge can be achieved not only in the low temperature range (<600° C.) but also in the range of pure radiant heat (>600° C.). For this purpose, in the lower temperature range, the gas, which is at atmospheric pressure or is pressurized, is forced through the heating elements into the heating chamber, as a result of which a very good convective heat transfer results between the heating elements and the gas, resulting in a high exit temperature of the gas. If the furnace is operated in the high temperature range, the large specific surface area of the heating elements enables a significant emission of thermal radiation. In addition, the thin walls of the heating elements enhances the reduction of the temperature thereof at the beginning of the cooling phase. Thus, the present invention makes it possible to operate the furnace at high efficiency not only during the heating phase but also during the cooling phase.

Pursuant to one specific embodiment of the present invention, the heating elements are disposed vertically in the heating chamber, with gas flowing therethrough from the top toward the bottom. In this manner, the structural configuration of the furnace is particularly straightforward, with the heating gas that exits the heating elements passing into the lower portion of the charge, where it leads to a desired preferred heating-up. For this purpose, pursuant to a further feature of the present invention, the bottom of the heating elements can be open.

Pursuant to another specific embodiment of the invention, it can be advantageous to provide the heating elements with radial openings in order in this manner to be able to already thermally act upon the charge in a precise manner during the convective heating phase.

Pursuant to another specific embodiment of the present invention, the upper ends of the heating elements are secured in the heating chamber, as a result of which there is only a small contact surface between the heating elements and the heating chamber, so that the heat generated by the heating elements is nearly completely available for heating the heating gas or the charge.

It is also proposed pursuant to the present invention to secure the heating elements to the heating chamber via the interposition of ceramic sleeves. This nearly completely prevents the transfer of heat from the heating elements to the heating chamber, thereby in particular protecting the heat-sensitive parts of the fan.

Further specific features of the present invention will be described in detail subsequently.

DESCRIPTION OF THE PREFERRED EMBODIMENTS

Referring now to an embodiment shown by the drawing in detail, disposed in a tank-like, primarily cylindrical furnace housing 1 is a cylindrical heating chamber 2 that is constructed of refractory materials. Just like the furnace housing 1, the heating chamber 2 is formed from two parts, with the lower part of the heating chamber 2 being formed by a base 3, and the lower part of the furnace housing 1 being formed by a base 4. Secured to the base 4 of the vertically disposed furnace housing 1 the illustrated embodiment is provided with a plurality of support members 5 that extend through the base 3 of the heating chamber 2 and form a grid structure for receiving the charge 6 that is to be subjected to a thermal treatment. During the thermal treatment, the charge 6 rests upon the support members 5 within the heating chamber 2.

The embodiment includes a plurality of axially extending, tube-like heating elements 7 that are disposed in the vicinity of the inner surface of the heating chamber 2. These heating elements extend over a length that corresponds at least to the maximum height of the charge 6, so that the charge is surrounded by the individual heating elements 7. The heating elements 7 are cylindrical graphite tubes that are open both at the top and at the bottom. Depending upon the intended application, the heating elements 7 could also be made of molybdenum. Via the interposition of ceramic sleeves 8, the upper ends of the heating elements 7 are secured to a cover 9 of the heating chamber 2. In this connection, the heating elements 7 can not only be securely seated in the ceramic sleeves 8, but can also be suspended in the ceramic sleeves via suitable collars, with the vertical orientation of the heating elements 7 then being effected by gravity.

Disposed above the cover 9 of the heating chamber 2 is a chamber 10 in which is centrally disposed a blade of a fan 11 that is driven by a motor 12 that is secured thereabove. Via an annular intake passage 13 that opens out at the top of the heating chamber 2, gas is withdrawn from the interior of the heating chamber 2 to the front side of the fan 11. From this fan, the gas is conveyed radially outwardly into the chamber 10, from where, after flowing through the ceramic sleeves 8, the gas passes into the tubular heating elements 7. The fan 11 is comprised of heat-resistant material and is separated from the motor 12 by a suitable wall 14 that acts as a thermal shield. To protect the fan 11 from the heat radiation of the charge 6, a thermal shield 15 is formed by the annular intake passage 13 of the cover 9.

The upper and lower ends of the heating elements 7 are provided with electrical connections 16, 17 via which electrical current is supplied for heating up the heating elements 7. Via appropriate structural components, the electrical connections 16, 17 are for the most part thermally isolated from the components of the heating chamber 2 and the furnace housing 1, so that no undesired transfer of heat to the electrical connections can occur.

As indicated previously, the heating elements 7 are open toward the bottom, and in addition are provided with side openings 18 that are directed toward the charge 6. The size, position, and number of the openings 18 can vary in conformity with a particular application. In any case, it is advantageous to introduce the hot gas that exits the heating elements 7 into the lower region of the charge 6, where experience has shown that the mass that is to be heated up is the greatest, which is due, at least in part, to the fact that heat loss occurs via the support members 5.

Disposed in the surface as well as in the base 3 of the heating chamber 2, the embodiment further includes a plurality of cooling gas openings 19 via which cooling gas that is supplied from a non-illustrated blower passes into the interior of the heating chamber 2. The cooling gas openings 19, which are embodied as jets, are preferably oriented in such a way that the gas is blown directly against the charge 6. In order to achieve a directed cooling of individual regions of the charge, the cooling gas openings 19 can also be grouped together. The drawing illustrates how the lower and upper cooling gas openings 19 can be supplied separately via a lower distribution mechanism 20 and an upper distribution mechanism 21. Supply of cooling gas to the lower and upper distribution mechanisms 20 and 21 is effected via respective connectors 24 and 23. Further cooling gas openings 19 are disposed at the base 3 of the heating chamber 2. The cooling gas flowing out of these openings is supplied thereto via a distribution mechanism 22. Thus, the furnace embodiment described operates with three cooling zones that are supplied independently of one another. The heated cooling gas that exits from the interior of the chamber 2 passes via the intake passage 13, the fan chamber 10, and the hatch openings 25, which in this case are opened, into the interior of the furnace housing 1, from where they return to a heat exchanger via a suction connector 26. The hatch openings 25 are disposed on the top of the fan chamber 10 and are opened during only the cooling phase, remaining closed during the heating phase of the furnace.

The inventive furnace operates in the following manner:

With the base 4 removed, the charge 6 is placed upon the support members 5 and the base 4 is moved perpendicularly against the furnace housing 1, as a result of which the charge 6 passes into the interior of the heating chamber 2. The base 4 is secured in an airtight manner against the furnace housing 1 via appropriate fastening elements. Thereafter, the furnace is evacuated and an inert gas, such as nitrogen or argon, is introduced. After conclusion of this flooding process, the fan 11 is activated by the motor 12 and the heating elements 7 are heated up via the electrical connections 16, 17. The pressure in the furnace housing 1 is between 500 and 2000 mbar. The inert gas conveyed by the fan 11 passes via the chamber 10 into the heating elements 7, flows therethrough, during the course of which the gas is convectively heated, and then passes into the lower portion of the heating chamber 2. The hot gas that rises within the heating chamber 2 flows through the charge, convectively heating the same, and then returns via the intake passage 13 to the fan 11. This convective heating phase is terminated at a charged temperature of about 600° C. The fan 11 is shut off, and further heat transfer is effected practically exclusively via only the radiant heat that is transferred from the heating elements 7 to the charge 6. To begin this second heating phase, the interior of the furnace housing 1 is again evacuated so that the radiant heat of the heating elements 7 need not be used to further heat up the inert gas. In the resulting vacuum, the heat transfer is effected exclusively by radiation, with the magnitude of this radiation depending, in addition to the size of the radiating surface of the heating elements 7, to a large extent upon the temperature of these heating elements. The heat exchange during this heating phase, that takes place in a vacuum, occurs with the same heating elements as the primarily convective heat transfer at the beginning of the heating process. Due to the convective heat transfer in the low temperature range, heating of the charge is significantly accelerated at the beginning of the heating phase.

After the desired final temperature has been achieved, the heating elements 7 are shut off. Subsequently, the cooling cycle is initiated, so that the cooling gas that is distributed via the distribution mechanisms 20, 21, and 22 flows into the interior of the heating chamber 2 via the cooling gas openings 19, and cools off the charge 6. By controlling the quantity of cooling gas, this cooling of the charge 6 can be effected in a regulated manner in order to achieve a specific structure in the material of the charge. Since the heating elements 7 are disposed in the region where the cooling gas openings 19 that are mounted in the surface of the heating chamber 2 open out, the heating elements 7 are already greatly cooled off immediately after the start of the cooling process, so that the heating elements can no longer give off appreciable thermal radiation. After the charge 6 has been cooled off to the withdrawal temperature, the furnace housing 1 and the base 4 are again separated from one another, so that the base 4 can be lowered vertically in order to permit the charge 6 to be withdrawn.

The present invention is, of course, in no way restricted to the specific disclosure of the specification and drawing, but also encompasses any modifications within the scope of the appended claims.

What we claim is:

1. In a furnace for the thermal treatment of charges of iron and steel components, with said furnace including a housing, a heating chamber disposed in said housing, and electrically energized heating elements that are disposed in said heating chamber for heating up said charge, the improvement wherein:

said heating elements have a tubular construction and are adapted to receive a flow of gas therethrough for heating up same, said heating chamber including wall means provided with cooling gas openings that open out into said heating chamber, with said heating chambers being disposed in the vicinity of where said cooling gas openings open out.

2. A furnace according to claim 1 which is vertically disposed, with said heating elements being vertically disposed in said heating chamber, and with gas flowing through said heating elements from the top toward the bottom.

3. A furnace according to claim 2, in which said heating elements are open at the bottom.

4. A furnace according to claim 2, in which said heating elements are provided with radial openings.

5. A furnace according to claim 2, in which upper ends of said heating elements are secured in said heating chamber.

6. A furnace according to claim 5, in which said heating elements are secured in said heating chamber via the interposition of ceramic sleeves.

7. A furnace according to claim 2, which includes fan means for circulating said gas.

8. A furnace according to claim 7, in which said heating chamber has an upper end provided with annular intake passage means that opens out into said heating chamber and establishes communication from said heating chamber to said fan means; and which includes a thermal shield that is disposed between said heating chamber and said fan means.

9. In a furnace for the thermal treatment of charges of iron and steel components, with said furnace including a housing, a heating chamber disposed in said housing, and electrically energized heating elements disposed vertically in the heating chamber for heating up said charge, said heating elements having a tubular construction and having fan means for circulating said gas flowing through said heating elements from the top toward the bottom, comprising the improvement wherein: a cover is provided for the heating chamber and upper open ends of said heating elements are secured to said cover independently of each other; and fan chamber means are provided with said fan means above said cover, said fan means having connection with an intake passage of said fan chamber means to pump the gas suctioned from below simultaneously to pass downwardly through the individual heating elements.

10. A furnace according to claim 9, in which said heating elements are open at the bottom.

11. A furnace according to claim 9, in which said heating elements are provided with radial openings.

12. A furnace according to claim 11, in which said heating elements are secured in said heating chamber via interposition of ceramic sleeves.

13. A furnace according to claim 9, in which a thermal shield arranged between the heating chamber and the fan means delimits said intake passage.

14. A furnace according to claim 9, in which said heating chamber includes wall means provided with cooling gas openings that open out into said heating chamber, with said heating elements being disposed in the vicinity of where said cooling gas openings open out.

* * * * *